United States Patent [19]

Brandl et al.

[11] Patent Number: 5,072,994

[45] Date of Patent: Dec. 17, 1991

[54] SHEARING MACHINE WITH MOVABLE SHEARING DRUM AND CONVEYOR

[75] Inventors: Erich Brandl, Grosslobming; Wolfgang Koch, Weisskirchen; Alfred Zitz, Zeltweg, all of Austria

[73] Assignee: Voest-Alpine Zeltweg Gesellschaft m.b.H., Linz, Austria

[21] Appl. No.: 523,526

[22] Filed: May 15, 1990

[30] Foreign Application Priority Data

May 17, 1989 [AT] Austria ..... 1187/89

[51] Int. Cl.[5] ..... E21C 27/24; E21C 35/12

[52] U.S. Cl. ..... 299/67; 299/76

[58] Field of Search ..... 299/64, 67, 75, 76

[56] References Cited

U.S. PATENT DOCUMENTS 4,878,714 11/1989 Barnthaler et al. ..... 299/67

FOREIGN PATENT DOCUMENTS 354961 11/1978 Austria .

361283 2/1973 U.S.S.R. ..... 299/64

*Primary Examiner*—David J. Bagnell

*Attorney, Agent, or Firm*—Cushman, Darby & Cushman

[57] ABSTRACT

A shearing machine with shearing heads or drums rotatably mounted on a luffable shearing arm and a loading ramp or a conveyor running in the direction of the heading face for receiving and conveying away the sheared material. The loading ramp or the conveyor is supported displaceably in the longitudinal direction of the shearing machine on the machine frame and the horizontal luffing axis of the shearing arm runs transversely to the longitudinal direction of the machine and is mounted adjustably relative to the machine frame in the longitudinal direction of the machine. The adjustment movement of the horizontal luffing axis of the shearing arm is coupled to the adjusting movement of the loading ramp or of the conveyor. The shearing arm is mounted on a bearing bracket which is connected to a carriage. The carriage is displaceable on guides running in the longitudinal direction of the machine and the bearing bracket is connected to a driver which is formed by a slot guide. After a predetermined displacement distance of the bearing bracket in the longitudinal direction of the machine, the bearing braket interacts with the conveyor.

9 Claims, 4 Drawing Sheets

FIG. 5
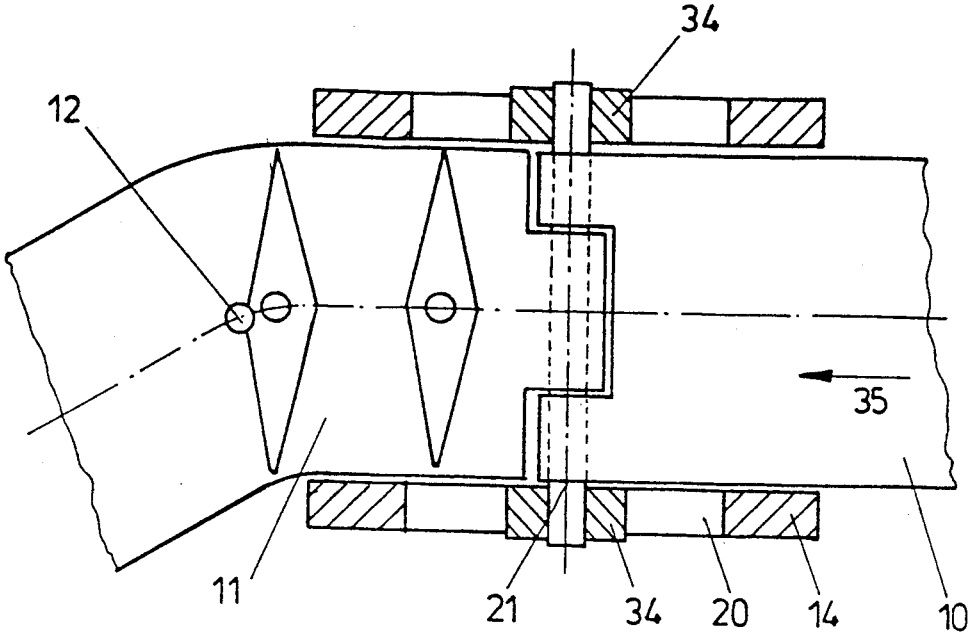
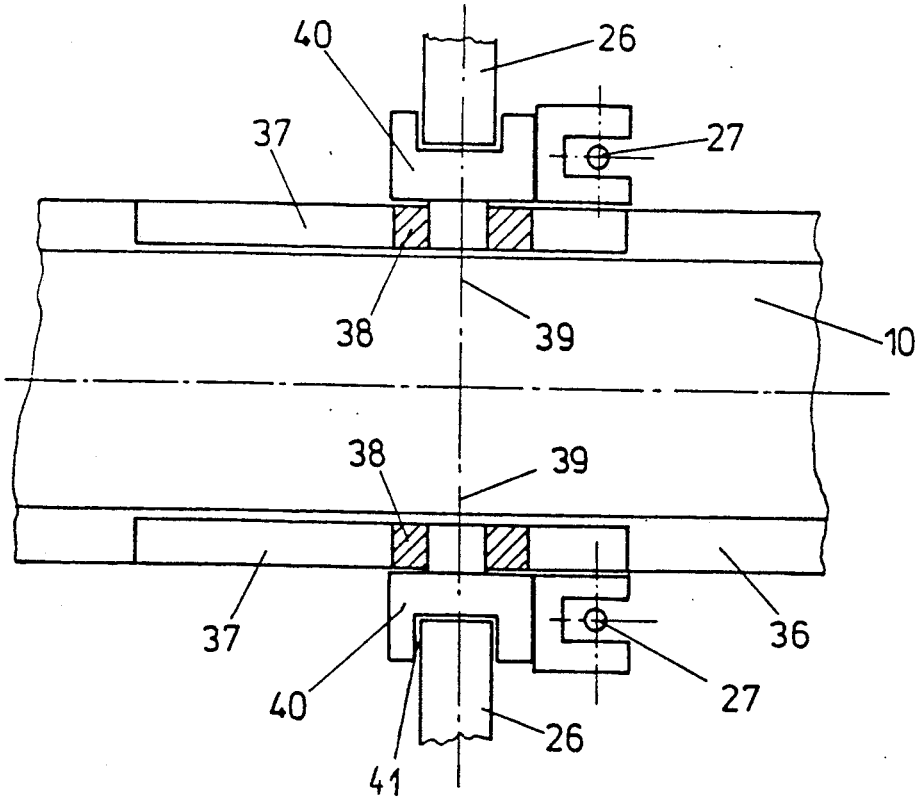
FIG. 6

SHEARING MACHINE WITH MOVABLE SHEARING DRUM AND CONVEYOR

BACKGROUND OF THE INVENTION

1. Field of the Invention

The invention relates to a shearing machine with shearing heads or drums rotatably mounted on a luffable shearing arm and with a loading ramp or a conveyor running in the direction of the heading face for receiving and conveying away the sheared material. The loading ramp or the conveyor is supported displaceably in the longitudinal direction of the shearing machine on the machine frame and the horizontal luffing axis of the shearing arm runs transversely to the longitudinal direction of the machine and is mounted adjustably relative to the machine frame in the longitudinal direction of the machine. The adjusting movement of the horizontal luffing axis of the shearing arm is coupled to the adjusting movement of the loading ramp or of the conveyor.

2. Description of the Related Art

Austrian Patent Specification 386,457 has disclosed a shearing machine of the type mentioned at the beginning. In the case of this known design of the shearing machine, the object was to permit an exact positioning of the loading ramp or of the conveying-away means even when the shearing machine is not moved along. However, the positive coupling, provided in Austrian Patent Specification 386,457, of the displacing movement of a conveyor with the displacing movement of the luffing axis of a shearing arm of a shearing machine cannot always be considered optimal. In particular, during break-in shearing, i.e. at the beginning of a new shearing operation at the heading face. During break-in shearing, in particular whenever the shearing head is advanced into the heading face close to the roof, at first a certain break-in depth is prescribed, which is intended to apply subsequently for the downward shearing at the heading face. In particular in the case of drum shearing machines, the preselected break-in depth is always maintained during downward luffing of the shearing arm in the vertical direction and, with a positive coupling of the movement of the loading ramp with the breaking-in or penetrating movement of the shearing head or of the shearing drum. The breaking-in or penetrating operation may be hindered by the loading ramp, since for example, when penetrating close to the roof, the loading ramp cannot be driven into the heading face far enough at the floor. In the case of such an operation, the known positive coupling of the displacing movements therefore requires an adjustment in which the loading ramp is forced always to remain a certain amount behind the shearing head, in order not to hinder the shearing work during break-in shearing.

It may be advantageous in particular in the case of lightweight machines to anchor the machine in the roadway and a moving-along of the machine itself for the purpose of break-in shearing is not of advantage, not least because, during a moving-along of the machine itself, to achieve the necessary break-in or penetrating depth, an exact control of this depth is not readily achieved. For this reason, on the machine known from Austrian Patent Specification 386,457 as well, a design of the mounting of the jib or shearing arm was chosen which permits displacement of this mounting in the direction of the heading face with the machine at a standstill.

SUMMARY OF THE INVENTION

The present invention is now based on the object of providing a relatively lightweight machine on which large displacement distances can be accomplished without actuation of the travelling drive of the shearing machine and consequently a large axial area of the roadway can be developed from a predetermined position of the shearing machine. At the same time, the present invention is based on the object of ensuring, in particular in work in which break-in shearing takes place close to the roof, an exact positioning of the loading device directly even during break-in shearing, so that immediately after commencement of break-in shearing a reliable and substantially complete clearing of the floor can be carried out. Furthermore, the present invention is based on the object of ensuring an exact guidance of the jib of a shearing drum as well as a precise guidance and pressing into place of the conveying device over a large axial length of the machine. To achieve this object, the invention consists substantially in that the shearing arm is mounted on a bearing bracket which is connected to a carriage. The carriage is displaceable on guides running in the longitudinal direction of the machine and the bearing bracket is connected to a driver which is formed by a slot guide. After a predetermined displacement distance of the bearing bracket in the longitudinal direction of the machine, interacts with the conveyor. Due to the fact that the shearing arm is mounted on a bearing bracket fixed to a carriage, the carriage can be displaced over a great length on guides running in the longitudinal direction of the machine, as a result of which a large axial length of the roadway can be developed from a preselected position of the machine without having to move the machine along. Due to the fact that the conveying device is now connected to the bearing bracket or to the carriage by means of a driver which, in a first zone, prevents the conveyor being taken along and this taking-along only takes place after a predetermined displacement distance has been covered in the driver. Thus it is ensured even during break-in shearing that the loading ramp or the conveyor can remain directly at the heading face without the movement of the jib in the axial direction thereby being hindered. The device according to the invention is consequently suitable with preference for breaking-in in the roof area, which is followed by shearing down from the roof to the floor, after which the shearing drum can be withdrawn and the floor consequently cut subsequently. During withdrawal of the shearing drum in the floor area, on account of the slot guidance of the drivers, a corresponding withdrawal of the conveyor takes place with delayed travel to an extent which prevents a collision of the shearing head or the shearing drum with the conveyor during every phase of the cutting operation. After withdrawal of the shearing jib or shearing arm into the next break-in position on the roof, in turn the following-on of the loading ramp with delayed travel takes place, resulting in that the loading ramp can always remain close to the heading face. In this way, an even transporting-away of the cut material in every phase is ensured.

The sure contact of the front end of the conveyor or of the loading ramp against the floor is ensured in a structurally simple way by the conveyor being guided displaceably in the longitudinal direction and the vertical direction close to the front edge of the machine frame and being capable of being pressed against the floor by means of a hydraulic cylinder-piston unit. The supporting or pressing of the conveyor and of the loading ramp against the floor in this case takes place close to the actual bearing point of the conveyor or the loading ramp on the floor, with the result that the supporting or pressing forces introduced can be brought to bear particularly well.

In a structurally simple way, the shearing machine according to the invention is designed such that the hydraulic cylinder-piston unit acts on the conveyor in a substantially vertical direction and that the mounting or guidance of the conveyor at the front end of the machine frame is formed by a slot or a groove, running in the longitudinal direction of the machine, on the conveyor and by a pin engaging in the said slot or groove as well as by a slot or a groove or else an elevation, running transversely to the longitudinal direction of the machine in the vertical direction, on the machine frame, in which slot or groove or on which elevation a bearing of the pin is guided in a vertically displaceable manner. In this way, on the one hand a favorable force introduction of the pressing forces of the conveyor against the floor is accomplished with small cylinderpiston units and on the other hand an exact guidance of the conveyor at the front end of the machine frame is ensured, a guidance which cannot be overloaded even with high pressing forces against the floor. However, in particular in the case of long machines, in this way an exact lateral guidance is also ensured, with the result that no diagonal loading is introduced into the conveyor.

In a structurally simple way, the guide in the front region of the machine frame may be designed such that the vertically running slot or the groove or else the elevation of the machine frame is arranged on a support bracket, on which the hydraulic cylinder-piston unit for pressing the conveyor against the floor acts. Such a design allows the guide to be arranged in a relatively stable component, namely the support bracket, with the result that the remaining space close to the heading face is kept as large as possible, so that support work of the roadway is not hindered. The space available is also only taken up little by the fact that the design is arranged with preference such that the hydraulic cylinder-piston unit for pressing the conveyor against the floor is arranged substantially parallel to the vertically running slot or the groove or else the elevation, as a result of which at the same time an exact and sure force introduction into the floor is ensured.

A particularly simple and stable guidance of the carriage even in the case of lightweight machines over a large guiding length can be brought about by the guides for the carriage being formed by at least two tubes arranged outside the width of the conveyor, which tubes have at least partially engaging behind them guide parts of the carriage. In particular whenever such guides are kept relatively long, there is the possibility of bracing a lightweight machine in the roadway and, from such a braced position in the roadway, developing a large length of the roadway, at the same time a guidance which is secure against tipping over and diagonal loads being accomplished. Such guide bars also allow the space between the guides to be kept free, with the result that a correspondingly sizeable space is available for conveying away the sheared material.

In order to ensure in every position that the loading ramp or the conveying device does not hinder the penetrating operation or the break-in shearing operation, the design is arranged such that the length of the slot of the driver is chosen to be at least equal to the penetrating depth during break-in shearing.

The slot guide of the driver may interact in a simple way with bolts of the conveyor, it being possible for the conveyor to be swivel-mounted in the slot guide. Such a swivel axis of the conveyor in the slot guide of the driver may also be used, however, at the same time as the swivel axis for adjoining parts of the conveyor. The design is advantageously arranged such that the conveyor is guided over a cross bolt in the slot of the driver, two adjoining parts of the conveyor being connected at the cross bolt in such a way that they can be angled with respect to each other.

In order to ensure a secure support of the machine over the entire displacement distance of the carriage in the longitudinal direction and to prevent a tipping-over of the shearing machine even in extreme positions of the carriage, the design is advantageously arranged such that the undercarriage, in particular crawler undercarriage, of the shearing machine extends parallel to and at least over the length of the guides, running in the longitudinal direction of the machine, of the machine frame. The forces introduced via the guides into the machine frame are in this way taken up over the entire length by the crawler undercarriage and securely supported on the floor.

BRIEF DESCRIPTION OF THE DRAWINGS

The invention is explained in more detail below with reference to an exemplary embodiment diagrammatically represented in the drawing. In the drawing, FIG. 5 shows in detail the articulation of the conveyor on the bearing in the direction of the arrow V of FIG. 2; and FIG. 6 shows a section along the line VI—VI of FIG. 2, the vertically adjustable articulation of the conveyor close to the front edge of the shearing machine being shown.

DETAILED DESCRIPTION OF THE PREFERRED EMBODIMENT

Figure 1:
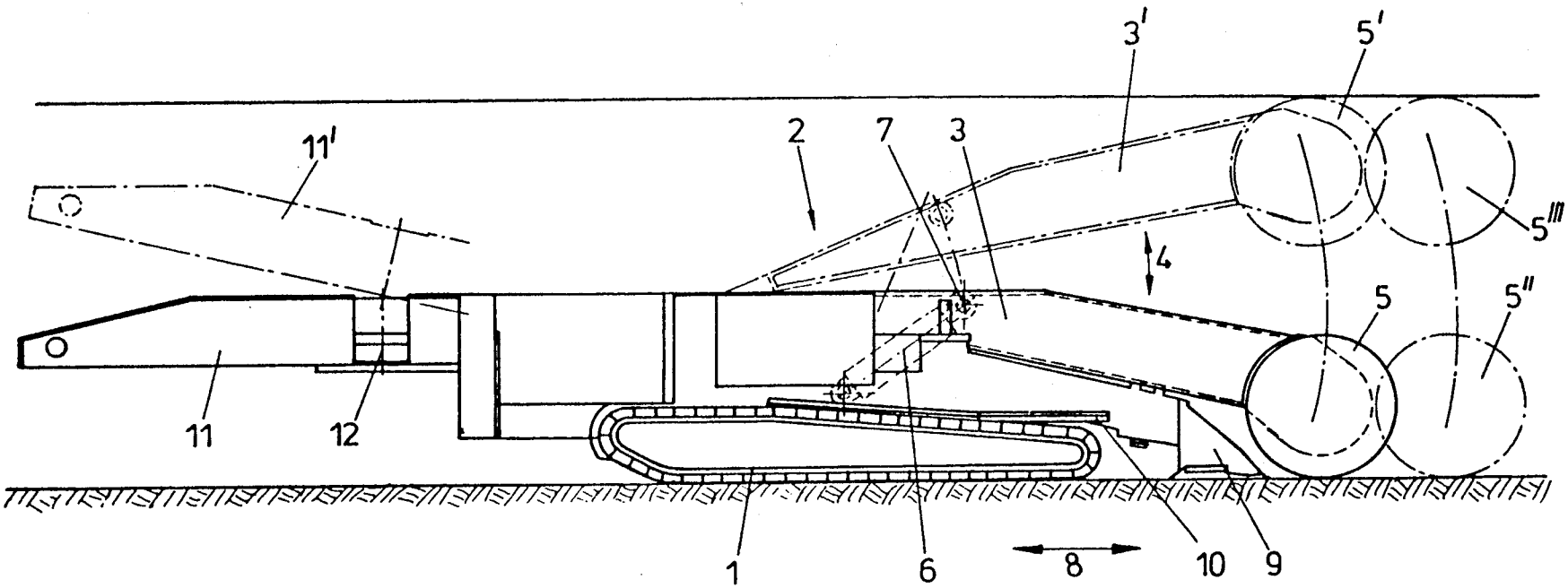
FIG. 1 shows a side view of a shearing machine according to the invention.

In FIG. 1, a shearing machine 2 which can move along on a crawler undercarriage 1 is shown. A rotatably mounted shearing drum 5 being arranged on a jib or shearing arm 3, which can be luffed in the direction of the double-headed arrow 4. In this case, a drive motor for the shearing drum 5 is arranged in a known way, for example in the shearing arm 3, and a part of the reduction gear mechanism is arranged inside the shearing drum. These known details are not shown in this case for the sake of clarity. The luffing of the jib 3 with the shearing drum 5 takes place in this case by means of a cylinder-piston unit 6, which is fixed to the jib in a swivelling manner at 7. As diagrammatically indicated in FIG. 1 and explained in more detail in the subsequent figures, the jib 3 with the shearing drum 5 is mounted displaceably in the direction of the double-headed arrow 8 relative to the machine frame of the shearing machine 2, this being indicated by the positions in broken lines 5" and 5'''. In FIG. 1, the lowered position of the shearing arm 3 with the shearing drum 5 is represented in solid lines and a first raised position is indicated in broken lines by 3' and 5', respectively.

The shearing machine 2 also has a loading device which is formed by a ramp 9 and goes over into a conveyor 10, running in the longitudinal direction of the machine. The conveyor 10 is in this case displaceable in the vertical direction at its rear end 11, as indicated by a raised position 11' and, furthermore, a lateral swivelling capability of the conveyor about a vertical axis 12 may also be provided.

Along with the adjustability of the jib 3 with the shearing drum 5 relative to the machine frame, the conveyor 10 with the loading ramp 9 can also be adjusted in the direction of the double-headed arrow 8 relative to the machine frame.

Figure 2:
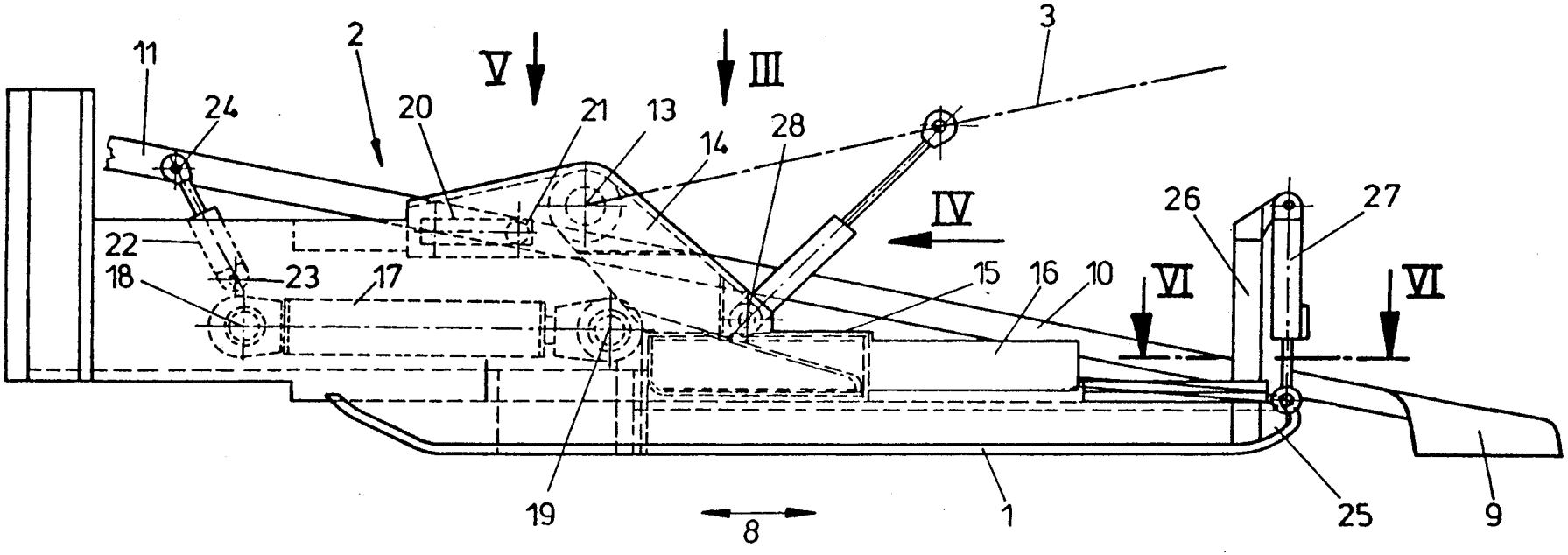
FIG. 2 shows a somewhat enlarged representation of a diagrammatic section through the longitudinal machine axis of the shearing machine according to FIG. 1, the bearing bracket and the carriage for the displacement of the shearing arm and of the conveyor being represented in more detail.

The adjustability of the jib 3 and of the conveyor 10 with the loading ramp 9 in the direction of the double-headed arrow 8 relative to the machine frame is carried out, as shown in FIG. 2, in such a way that the jib 3 is mounted in a swivelling manner about a substantially horizontal axis 13 on a bearing bracket 14 which is connected to a carriage 15 which is displaceable on guides 16 running in the longitudinal direction of the machine. The displacement of the bearing bracket 14 with the carriage 15 takes place in this case by means of a cylinder-piston unit 17, which is fixed at 18 in the rear part of the machine frame and acts at 19 on the bearing bracket 14 and the carriage 15. Also provided on the bearing bracket 14 is a slot guide 20, in which a pin or bolt 21 for the conveyor 10 with the loading ramp 9 engages, this detail being represented more closely in FIG. 5. Upon a displacement of the bearing bracket 14 via the carriage 15 on the guides 16, a shifting of the jib 3 with the shearing drum 5 in the direction of the heading face takes place, as a result of which, for example in break-in shearing, the shearing drum 5 penetrates into the heading face by a defined amount. Starting from the position represented in FIG. 2, the conveyor 10 with the loading ramp 9 in this case first of all remains in an unchanged position, in accordance with the slot guide 20, when there is a displacement of the carriage 15 with the bearing bracket 14, with the result that, after a penetrating operation carried out in the area of the roof, the entire heading face from the roof to the floor can be passed over by the shearing drum 5. The length of the slot 20 is in this case dimensioned substantially such that it is chosen at least equal to a penetrating depth during break-in shearing. In this way, during shearing from the roof to the floor, the loading ramp 9 is positioned directly up against the heading face and the conveyor 10 and the loading ramp 9 are not taken along by means of the slot guide 20 into a position again directly up against the heading face until renewed penetration in the area of the roof takes place. Due to the following-on guidance of the conveyor and the loading ramp taking place by means of the slot guide, it is avoided that movement of the loading ramp 9 relative to the machine frame already during the first penetrating operation of the shearing drum 5 is hindered by the not yet sheared region of the heading face in the area of the floor.

A cylinder-piston unit 22 for raising and lowering the conveyor 10 in its rear region 11 is in this case articulated on the machine frame in a swivelling manner at 23 and articulated on the conveyor, in its rear region 11, in a swivelling manner at 24. As illustrated in further detail in FIG. 5, in this case the horizontal swivel axis is provided in a simple way between the conveying sections in the region of the articulation 21 of the conveyor on the bearing bracket 14.

In the region of the front edge 25 of the machine frame, the conveyor 10 with the loading ramp 9 is guided displaceably in the vertical direction, a cylinder-piston unit 27, mounted on a bearing bracket 26, being used for pressing the loading ramp 9 against the floor. As illustrated in further detail in FIG. 6, in this case a guide in the vertical direction is provided on the machine frame or on the bearing bracket 26 and there is also a guide provided in the longitudinal direction of the machine on the conveyor 10, in order to permit a displacement of the conveyor 10 relative to the bearing bracket 26 and to the cylinder-piston unit 27. In this arrangement, if there is a displacing movement of the conveyor 10 with the loading ramp 9 in the direction of the arrow 8, a correction of the vertical position of the loading ramp 9 takes place at the same time by means of the cylinder-piston unit 27.

Figure 3:
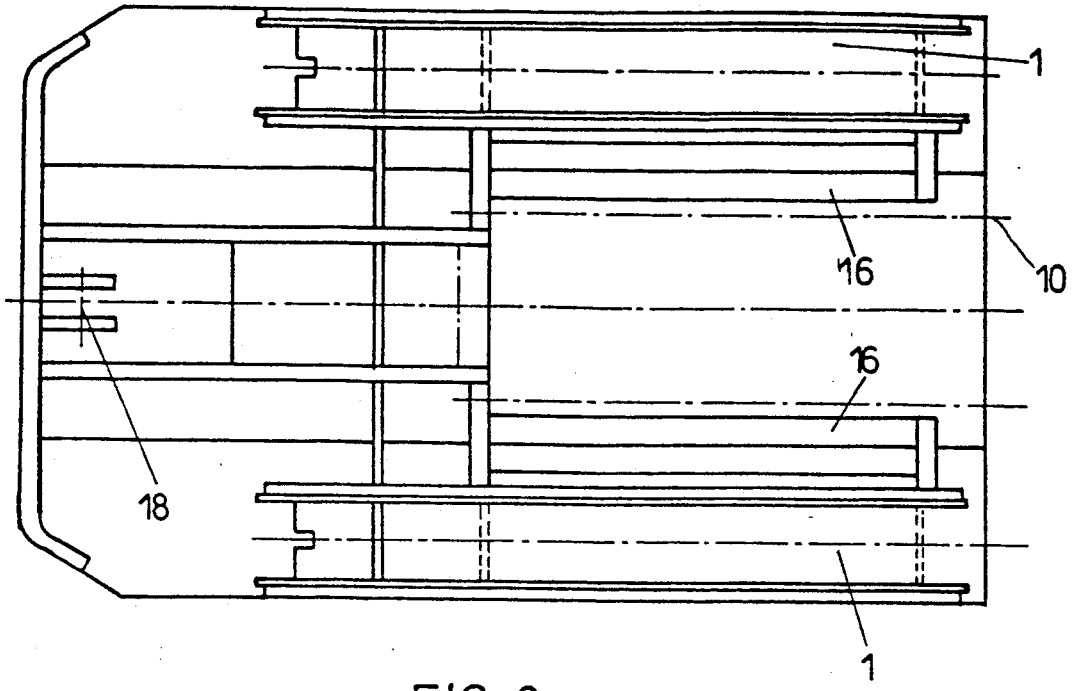
FIG. 3 shows a plan view in the direction of the arrow III of the design according to FIG. 2, both the shearing arm and the bearing bracket with the carriage not being shown.

In the partial plan view represented diagrammatically in FIG. 3, the frames of the crawler undercarriages 1 are represented. Furthermore, the guides 16, running in the longitudinal direction of the machine, for the carriage for displacement of the jib as well as of the conveyor and of the loading ramp can be seen. These guides 16, which are formed for example by tubes, are in this case arranged outside the width of the conveyor, the position of the conveyor being indicated in FIG. 3 in broken lines. It can also be seen that the crawler undercarriages 1 extend parallel to the guides 16 and are made longer than the guides 16. In FIG. 3, the point of articulation 18 for the cylinder-piston unit 17 (not shown) for displacement of the bearing bracket and of the carriage on the guides 16 is also indicated.

Figure 4:
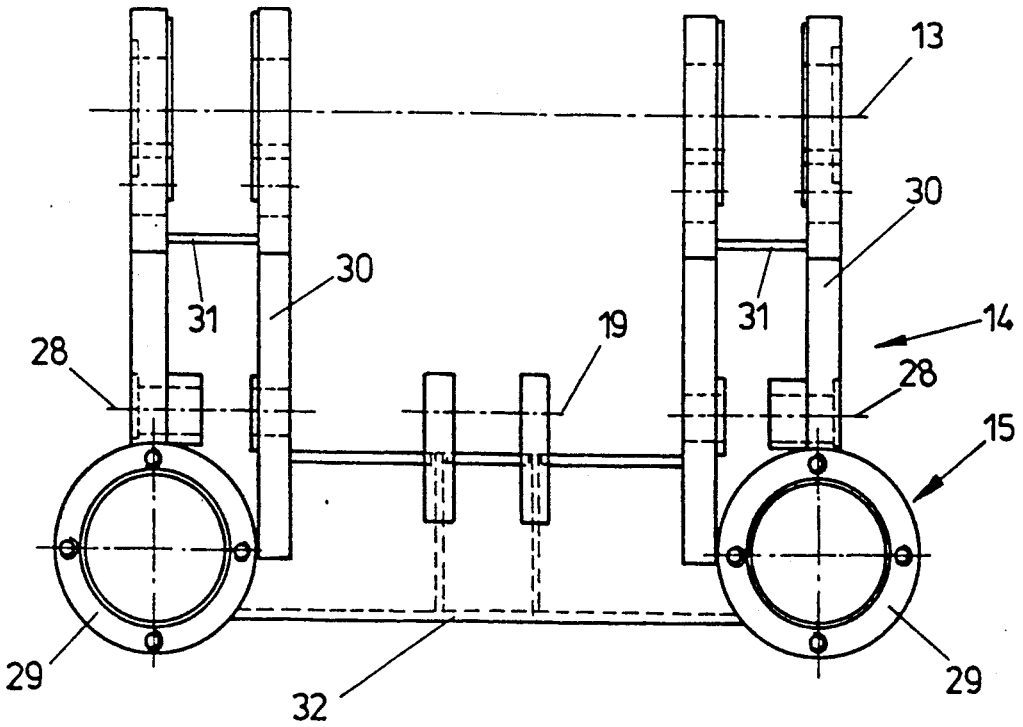
FIG. 4 shows a view in the direction of the arrow IV of the bearing bracket for the shearing arm and the conveyor as well as for the carriage.

In the case of the enlarged section through the bearing bracket 14 and the carriage 15, represented in FIG. 4, the reference numerals of FIG. 2 have been retained. In this figure, the axis of articulation 13 for the jib (not shown in any more detail) can be seen and, furthermore, the swivel axes for the cylinder-piston units for raising and lowering the jib on the bearing bracket are denoted by 28. The guide parts of the carriage 15 are formed in the case of the design according to FIG. 4 by tubes 29, which completely surround the guides 16, running in the longitudinal direction of the machine, of the machine frame. For a corresponding stability for absorbing the forces occurring, the bearing bracket is formed by profiles 30, which are arranged on both sides of the jib and of the centrally disposed conveyor (not shown in any more detail in FIG. 4) and are connected to each other by means of reinforcing profiles 31. The profiles connecting the carriage or the tubes 29 are denoted by 32.

In FIG. 5, the articulation or mounting of the conveyor on the bearing bracket 14 is illustrated in more detail. The conveyors 10 and 11 are in this case guided over the cross bolt 21 in the slot 20 of the bearing bracket 14 by means of guides 34, the cross bolt 21 representing the common swivel axis between the conveyors 10 and 11. In this case, the conveyor is divided in the region of the cross bolt 21 into two sections, the rear section, downstream in the conveying direction 35, being denoted in turn by 11 and, as not shown in any more detail, being intended to be raisable and lowerable relative to the front conveyor 10. In FIG. 5, the vertical axis 12 for swivelling a rear zone of the conveyor is indicated, again diagrammatically.

In FIG. 6, the articulation of the conveyor in the region of the front edge of the shearing machine is shown in more detail. In this case, the conveyor 10 has on its outside 36 grooves 37 which run in the longitudinal direction of the conveyor and in which sliding pieces 38, which can swivel about the axis 39, are guided. The length of the recesses or grooves 37 in this case corresponds to the maximum displacement distance of the conveyor 10 relative to the machine, as given by the length of displacement of the carriage taking into account the slot guide on the carriage. The sliding pieces or pins 38 are in this case connected via bearings 40 to the cylinder-piston units 27 for raising and lowering the conveyor 10 and for pressing into place the loading ramp, the pins or sliding pieces 38 or their bearings 40 also being guided on the respective anchoring bracket 26, which is firmly connected to the machine frame, in inter-engaging guides in the form of grooves 41 and elevations, the cylinder-piston units 27 likewise being mounted on the support brackets 26, as already mentioned with regard to FIG. 2. Instead of the guidance and vertical adjustability of the conveyor 10 shown in FIG. 6, by means of pins or sliding pieces 38 guided in a slot or a groove on the conveyor, the design may of course also be arranged such that a pin which is guided in a corresponding slot guide on the support bracket 26 is connected to the conveyor, a substantially similar mounting also being provided for guidance in the vertical direction.

We claim:

1. A shearing machine, comprising:

a machine frame;

means for shearing rotatably mounted on a luffable shearing arm;

means for conveying extending in a direction of a heading face to be sheared for receiving a conveying away sheared material, said conveying means being movably supported along a longitudinal direction of said machine frame;

a horizontal luffing axis joint, connected to said shearing arm and extending transversely to said longitudinal direction of said machine frame, said luffing axis joint being movable relative to said machine frame in said longitudinal direction of said machine frame, the movement of said horizontal luffing axis joint of said shearing arm being operatively coupled to the movement of said conveying means by mounting said shearing arm on a bearing bracket which is fixedly attached to a carriage, said carriage being movably mounted on guides extending in said longitudinal direction of said machine frame, said bearing bracket being connected to a driver which is formed by a slot guide, and wherein after said bearing bracket is displaced a predetermined distance in said longitudinal direction of said shearing machine, said bearing bracket interacts with said means for conveying so as to effect movement of the same in said longitudinal direction.

2. Shearing machine according to claim 1, wherein the conveyor is guided displaceably in the longitudinal direction and a vertical direction close to the front edge of the machine frame and is capable of being pressed against the floor by means of a hydraulic cylinder-piston unit.

3. Shearing machine according to claim 2 wherein the hydraulic cylinder-piston unit acts on the conveyor in a substantially vertical direction and in that a the mounting or guidance of the conveyor at the front end of the machine frame is formed by a slot or a groove, running in the longitudinal direction of the machine, on the conveyor and by a pin engaging in the said slot or groove as well as by a groove and elevation, running transversely to the longitudinal direction of the machine in the vertical direction, on the machine frame, in which groove and elevation a bearing of the pin is guided in a vertically displaceable manner.

4. Shearing machine according to claim 3, wherein the vertically running groove elevation of the machine frame is arranged on a support bracket, on which the hydraulic cylinder-piston unit for pressing the conveyor against the floor acts.

5. Shearing machine according to claim 4, wherein the hydraulic cylinder-piston unit for pressing the conveyor against the floor is arranged substantially parallel to the vertically running and elevation.

6. Shearing machine according to one of claims 1, 2 or 3, wherein the guides for the carriage are formed by at least two tubes arranged outside the width of the conveyor, which tubes have at least partially engaging behind them guide parts of the carriage.

7. Shearing machine according to one of claims 1, 2 or 3, wherein the length of the slot guide of the driver is chosen to be at least equal to the penetrating depth during break-in shearing.

8. Shearing machine according to one of claims 1, 2 or 3 characterized in that the conveyor is guided over a cross bolt in the slot guide of the driver, two adjoining parts of the conveyor being connected at the cross bolt in such a way that they can be angled with respect to each other.

9. A shearing machine as claimed in claim 1, 2 or 3, further comprising:

a crawler undercarriage extending, in a longitudinal direction, parallel to said guides.

* * * * *